US006672555B2

(12) United States Patent
Chang

(10) Patent No.: US 6,672,555 B2
(45) Date of Patent: Jan. 6, 2004

(54) STRUCTURE OF A SUSPENSION DEVICE FOR DISPLAYING ARTICLES

(76) Inventor: Chi Tsai Chang, PO Box 82-144, Taipei (TW)

( * ) Notice: Subject to any disclaimer, the term of this patent is extended or adjusted under 35 U.S.C. 154(b) by 57 days.

(21) Appl. No.: 10/052,751

(22) Filed: Jan. 23, 2002

(65) Prior Publication Data

US 2003/0205655 A1 Nov. 6, 2003

(51) Int. Cl.[7] ..... A47H 1/10

(52) U.S. Cl. ..... 248/317; 206/378; 206/806; 211/70.6

(58) Field of Search ..... 248/317, 225.11, 248/224.8, 309.1, 316.2; 211/70.6, 59.1; 206/378, 806, 349, 493, 461

(56) References Cited

U.S. PATENT DOCUMENTS 4,043,453 A * 8/1977 Greenlee ..... 206/349
5,425,519 A * 6/1995 Budert ..... 248/214
5,740,911 A * 4/1998 Chou ..... 206/378
5,855,284 A * 1/1999 Dembicks ..... 211/70.6
5,897,001 A * 4/1999 Dembicks ..... 211/70.6
6,032,797 A * 3/2000 Kao ..... 206/378
6,070,745 A * 6/2000 Dembicks ..... 211/70.6
6,250,466 B1 * 6/2001 Ernst ..... 206/378
6,273,255 B1 * 8/2001 Rosler ..... 206/378
6,386,363 B1 * 5/2002 Huang ..... 206/378
6,415,933 B1 * 7/2002 Kao ..... 211/70.6
6,454,092 B1 * 9/2002 Lee ..... 206/378

* cited by examiner

*Primary Examiner*—Leslie A. Braun
*Assistant Examiner*—Kofi Schulterbrandt
(74) *Attorney, Agent, or Firm*—Leong C. Lei

(57) ABSTRACT

An improved structure of a suspension device for displaying articles is disclosed. The present device for displaying comprises a suspension board and a fixing element for insertion at the bottom end neck portion thereof characterized in that the bottom end neck portion directly extended to an elastic fixing element formed from bending of a plate for the insertably mounting with a work piece, and one end of the plate is extended to a wider plate edge inclined at one direction having a small connection plate connected to the suspension board to form a body thereby the suspension device is safe to hang displaying articles.

1 Claim, 4 Drawing Sheets

STRUCTURE OF A SUSPENSION DEVICE FOR DISPLAYING ARTICLES

BACKGROUND OF THE INVENTION (a) Technical Field of the Invention

The present invention relates to a suspension device, and in particular, an improved structure of a suspension device for displaying articles for sales.

(b) Description of the Prior Art

FIGS. 5 and 6 show conventional suspension device 30 having a body board with an elongated slot for hooking onto a hook or the like of a displaying rack. The bottom edge of the board is a neck portion extended to form a fixing element 32 for mounting with an insertion hole of a mounting work piece 20. The fixing element 32 is provided with recessed or protruded position body 33 so that the suspension device can be easily mounted with the work-piece 20. However, if the mounting of the fixing element with a displaying article is not exact, dislocation of the article will be occurred if the device is being knocked or impacted. As for this conventional suspension device, if the suspension board 30 and the working piece 20 are held by the hands, the displayed article is easily removed.

To overcome this drawback, some designer has introduced a T-shaped rod 35 to match with an insertion hole 34 provided on the fixing element 32. As shown in FIG. 7, the working-piece 20 will not be easily removed and the displayed article is safe from unauthorized removal. However, the T-shaped rod 35 may not be easily inserted into the insertion hole 34. Besides, the length of the wing structure of the T-shaped rod 35 has to be changed based on the size of the working piece. In other words, molding of the wing structure is laborious and time-consuming. Accordingly, it is an object of the present invention to provide an improved structure of a suspension device for displaying articles, which mitigates the above drawbacks.

SUMMARY OF THE INVENTION

Accordingly, it is an object of the present invention to provide an improved structure of a suspension device for displaying articles, wherein the fixing element is connected to the suspension board by a connection plate such that the mounting with a work piece will not be easily dislocated.

Yet another object of the present invention is to provide an improved structure of a suspension device for displaying articles, wherein the center of the fixing element is directly connected to the suspension board as a unit such that the board will not be deformed, and a firmly secured and safe suspension of a displayed article are obtained.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
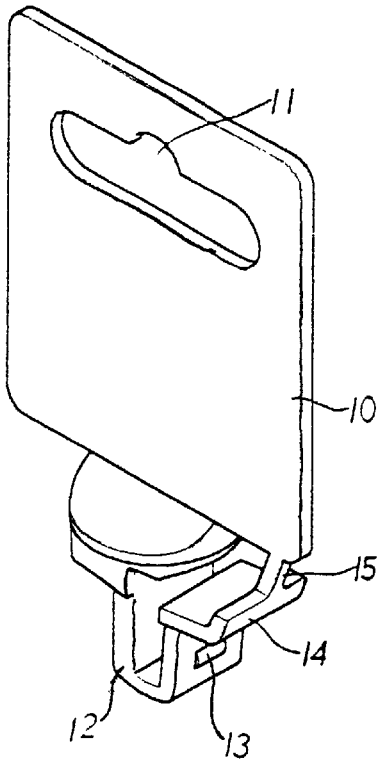
FIG. 1 is a perspective view of an improved structure of a suspension device for displaying articles in accordance with the present invention.
Figure 2:
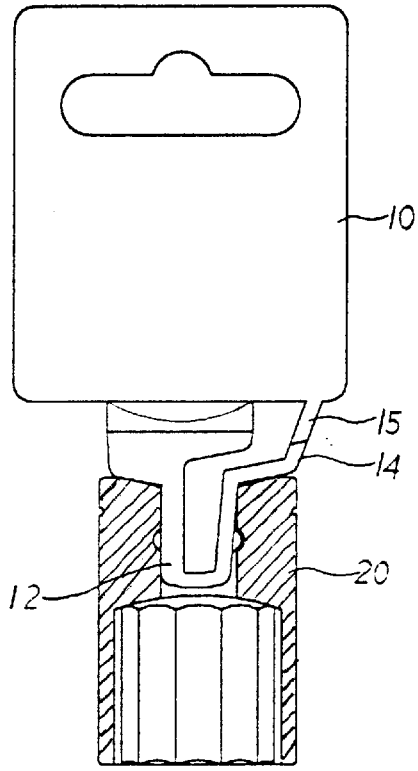
FIG. 2 is a sectional view showing the insertion module of the suspension device of an improved structure of a suspension device for displaying articles in accordance with the present invention.

Referring to FIGS. 1 and 2, there is shown an improved structure of a suspension device for displaying marketing goods comprising a suspension board 10 as a suspension body with a wide surface, and a U-shaped fixing element 12, wherein the upper center section of the suspension board 10 is provided with a horizontal elongated slot 11 for insertably mounting with a hook or the like (not shown) of a displaying rack (not shown). The fixing element 12 is a bending plate, which is to be inserted into the center slot (not shown) of a work-piece 20 for suspension. The bottom edge of the suspension board 10 may be formed into a neck portion and the bottom edge of the neck portion of the board 10 is connected to the fixing element 12 by means of a connection plate 15 extended from a plate edge 14 of the fixing element 12.

The lateral sides of the fixing element 12 are provided with position body 13 for securing with the inner hole edge of the work-piece 20 so that the work-piece 20 will not be dislocated from the fixing element 12. By means of the connection of the connection plate 15 with the suspension board 10, the fixing element 12 will not be deformed and the work-piece is secured. Therefore, the displayed articles for sales are securely suspended for viewing of consumers.

In accordance with the present invention, the suspension device will achieve the objective of secured suspension for the reason that the inward compressed end of the work-piece 20 assures the mounting of the work-piece with the position body 13. When an external force is applied to detach the work-piece 20, the terminal end of the fixing element 12, will be extended outward dislocation as a result of external force is prevented. In particular, the connection of the connection plate 15 extended from the inclined board edge

Figure 3:
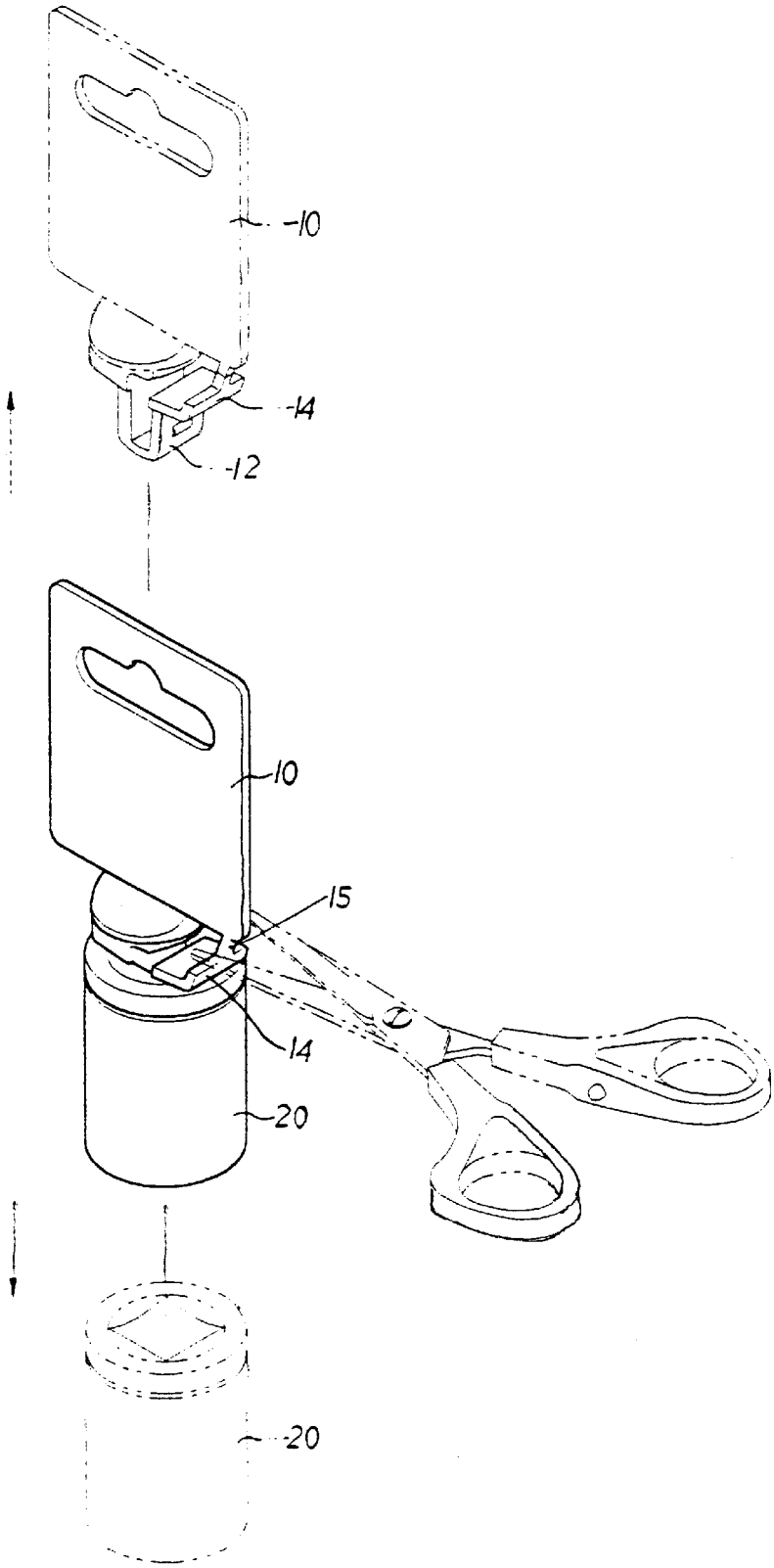
FIG. 3 schematically shows the separation of work piece with the suspension device of an improved structure of a suspension device for displaying articles in accordance with the present invention.
Figure 4:
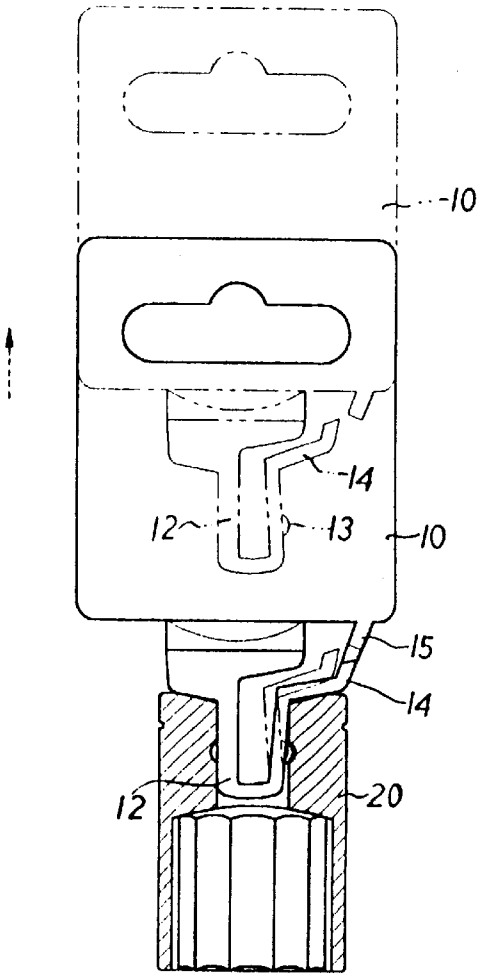
FIG. 4 schematically shows the separation of the suspension device with the work piece in accordance with the present invention.
Figure 7:
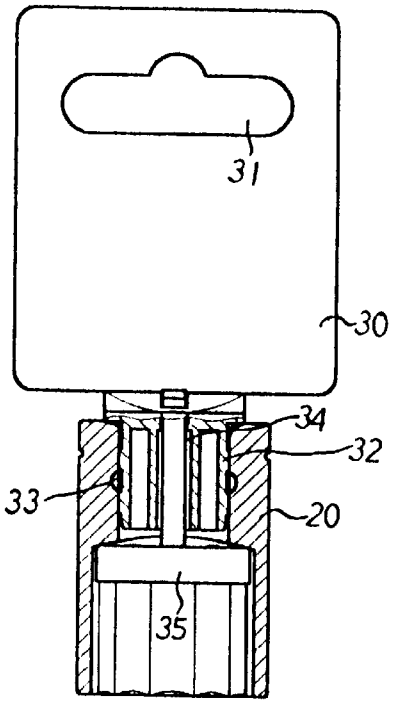
PRIOR ART FIG. 7
FIG. 7 is a sectional view showing another preferred embodiment in accordance with the present invention.
Figure 5:
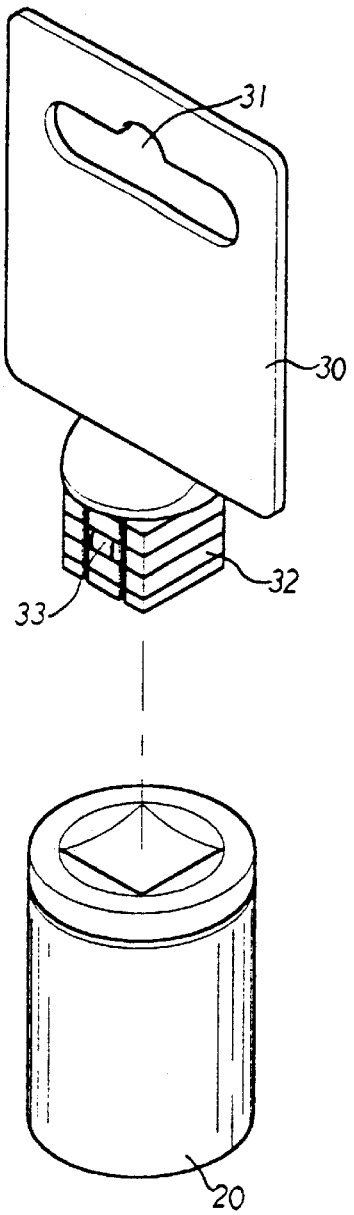
PRIOR ART FIG. 5
FIG. 5 is a perspective exploded view showing a work-piece with a convention suspension device.
Figure 6:
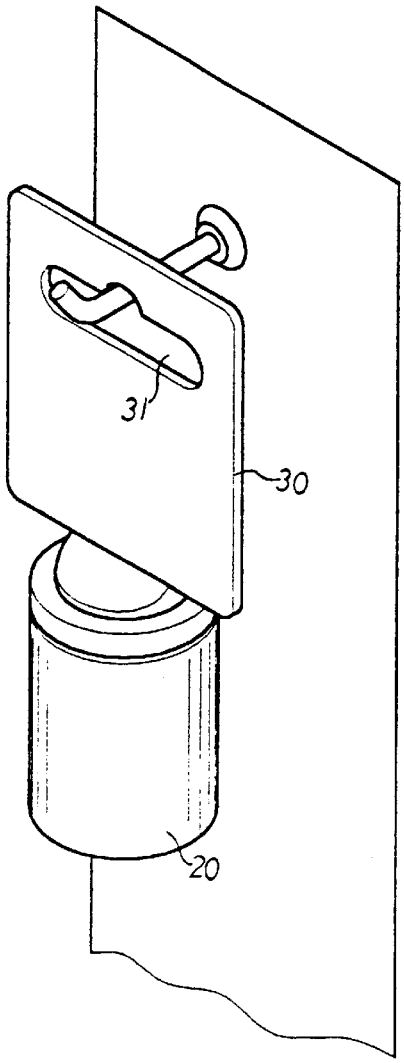
PRIOR ART FIG. 6
FIG. 6 is a schematic perspective view showing the conventional suspension device with the work piece.

14, with the bottom end of the suspension board 10 will assure secure of the suspension device. A pair of scissors is used to cut the connection plate 15 such that the mounting end thereof becomes a free end. That is, the end can be accessed and the board edge 14 of the free end is deformed towards the interior and the entire work-piece 20 can be easily withdrawn. Referring to FIGS. 3 and 4, the inclined board edge 14 of the extended end of the fixing element 12 can be cut and pushed upward, and the deform towards the center is similar and the work-piece 20 is withdrawn. Thus, the suspension device of the present invention achieves the objective of safe displaying of article.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a suspension device comprising a suspension board having an upper portion formed with a horizontal elongated slot, said suspension board having a bottom edge having a connection plate which is connected to a plate edge of a U-shaped fixing element, said U-shaped fixing element having two lateral sides each provided with a position body configured to engage with a recess of an article.

* * * * *